US005805530A

United States Patent [19]

Youngberg

[11] Patent Number: 5,805,530

[45] Date of Patent: Sep. 8, 1998

[54] SYSTEM, METHOD, AND DEVICE FOR AUTOMATIC SETTING OF CLOCKS

[76] Inventor: C. Eric Youngberg, 34 E. 1700 North, Mapleton, Utah 84664

[21] Appl. No.: 708,453

[22] Filed: Sep. 5, 1996

Related U.S. Application Data

[60] Provisional application No. 60/003,231 Sep. 5, 1995.

[51] Int. Cl.[6] ..... G04C 3/00

[52] U.S. Cl. ..... 368/47; 368/10

[58] Field of Search ..... 368/46–50

[56] References Cited

U.S. PATENT DOCUMENTS

| | | | |
|---|---|---|---|
| 3,643,420 | 2/1972 | Haydon . | |
| 3,681,914 | 8/1972 | Loewengart . | |
| 3,690,059 | 9/1972 | Haydon . | |
| 3,756,012 | 9/1973 | Kiss . | |
| 3,811,265 | 5/1974 | Cater . | |
| 4,023,344 | 5/1977 | Mukaiyama . | |
| 4,177,454 | 12/1979 | Shinoda et al. . | |
| 4,490,050 | 12/1984 | Singhi . | |
| 5,225,313 | 7/1993 | Darbee | 379/102 |
| 5,274,545 | 12/1993 | Allan et al. . | |
| 5,287,109 | 2/1994 | Hesse | 368/10 |
| 5,425,004 | 6/1995 | Staffan . | |
| 5,442,599 | 8/1995 | Burke et al. . | |
| 5,521,887 | 5/1996 | Loomis | 368/47 |

FOREIGN PATENT DOCUMENTS

| | | | |
|---|---|---|---|
| 76066 | 6/1977 | Japan | 368/187 |
| 62-145189 | 6/1987 | Japan . | |
| 2251319 | 7/1992 | United Kingdom . | |

*Primary Examiner*—Bernard Roskoski
*Attorney, Agent, or Firm*—Workman, Nydegger & Seeley

[57] ABSTRACT

A system, method, and device are disclosed for providing automatic setting of time of day and other information used by clocks and clock circuits/functions found in host devices such as household appliances, automobiles, wrist watches, computers and other electronic devices. The method and devices described bring an inexpensive automatic, and acceptably accurate procedure for getting the time of day and/or other information into these clocks. The system includes a remote host time piece device for maintaining the time of day and has a timebase with a reference from an electronic input. The system also includes a master time piece for obtaining the correct time and for transmitting the correct time to the remote host time piece device. Circuitry is included in the system for accepting the transmission of the correct time from the master time piece and for setting tile time of day in the remote host time piece device to the correct time transmitted from the master time piece. Also included in the system is circuitry, remote from the master time piece, for initiating from the master time piece the transmission of the correct time to the remote host time piece device upon the occurrence of at an event, such that the master time piece transmits to the remote lost time piece device an accuracy number that is used to determine based upon a selected tolerance whether the transmitted correct time from the master time piece is to be accepted for setting the time of day in the remote host time piece device to die correct time transmitted from the master time piece.

14 Claims, 12 Drawing Sheets

SYSTEM, METHOD, AND DEVICE FOR AUTOMATIC SETTING OF CLOCKS

This application claims the benefit of U.S. provisional application No. 60\003,231, filed Sept. 5, 1995.

BACKGROUND OF THE INVENTION

1. The Field of the Invention

The present invention is directed to a system, method, and device which enables the setting of clocks without the need for human intervention.

2. The Relevant Technology

Household kitchen appliances, alarm clocks, clock radios, watches and electronic products such as TVs, VCRs, and computers are "host" devices which incorporate inexpensive clocks to control various functions, including the display of time of day and/or date. The clocks in these devices typically have a timebase whose reference originates from:

(a) the AC mains line frequency;

(b) an inexpensive 32768 Hz resonator or oscillator;

(c) the oscillator of the microprocessor/control logic which governs operation of the host device; or (d) the master reference oscillator for RF devices, such as a receiver, transmitter, etc.

FIG. 1 shows a typical block diagram of a simple clock, or clock function within a host device.

In practical service within the typical home or office, clocks will gain or lose time with reference to an accepted standard (the clock at the local bank, the telephone company, or Universal Time Coordinated emanating from WWV short-wave radio). This drift of a household clock's time keeping ability correlates to the accuracy and stability of its internal timebase. In addition, clocks which utilize the AC mains as a reference oscillator often lose time completely when a power outage occurs, necessitating a reset to the correct local time. The resulting "blinking 12:00" on many appliances is a reminder that the clock must be set, in some cases before the appliance will even function.

OBJECTS AND BRIEF SUMMARY OF THE INVENTION

This invention provides a system/method which enables the setting of clocks without the need for human intervention. The minimum system has 3 components:

1) a master/transmitter clock/device, or master clock, which maintains the accuracy of time for all slave/receiving clocks/devices;

2) a slave/receiving clock/device, or slave clock, or host device (appliances, etc.) containing the slave clock circuit/function, configured to receive an update from the master clock; and 3) a method of communicating information from master to slave clocks. The system may employ more than one slave clock, and more than one method of communicating information from master to slave clock(s).

A primary objective of this system is to provide a means to update slave clocks which are inexpensive, maintain time utilizing their own timebase, and are updated only as needed.

Updates to the slave clocks are event driven. Typical events which would force an update or setting of the slave clock would be:

1) the user requests one (for example, by pushing a button); or 2) the hardware/software algorithm or design of the clock forces one after:

(a) a power outage has occurred, resulting in the clock circuits losing all time information; or (b) the clock has been operating for the period of time long enough to result in partial loss of time information (due to timebase inaccuracies, for example). In other words, enough time has elapsed that sufficient error has accumulated to warrant an update.

It is therefore an object of this invention to provide a method for automatically setting time of day and/or other information in clocks and clock circuits/functions contained within appliances and other host devices which utilize the AC mains frequency as a reference oscillator for the clock function.

It is also an object of this invention to provide a method for automatically setting time of day and/or other information in clocks and clock circuits/functions within wrist watches and host devices which utilize an internal, independent reference oscillator for the clock function (for example, 32768 Hz resonator or oscillator, or an oscillator which governs the operation of a microprocessor or other control hardware in the host device, or the master oscillator in RF equipment such as a transmitter or receiver).

It is also an object of this invention to provide the design for a master clock used to send the time of day and/or other information to slave clocks, or slave clock circuits/functions.

It is also an object of this invention to provide the design for a slave clock or slave clock circuit/function within a host device, for receiving time of day and/or other information from the master clock.

It is also an object of this invention to provide one or more communication methods used by the master and slave clock circuits for the communication of the time of day and/or other information.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
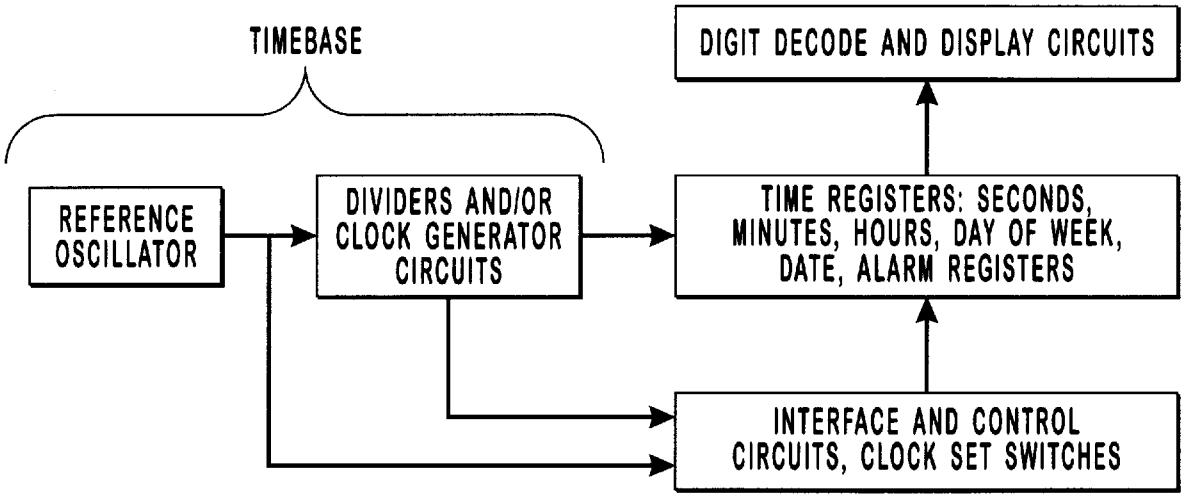
FIG. 1 describes in block diagram form a typical clock circuit/function.
Figure 2:
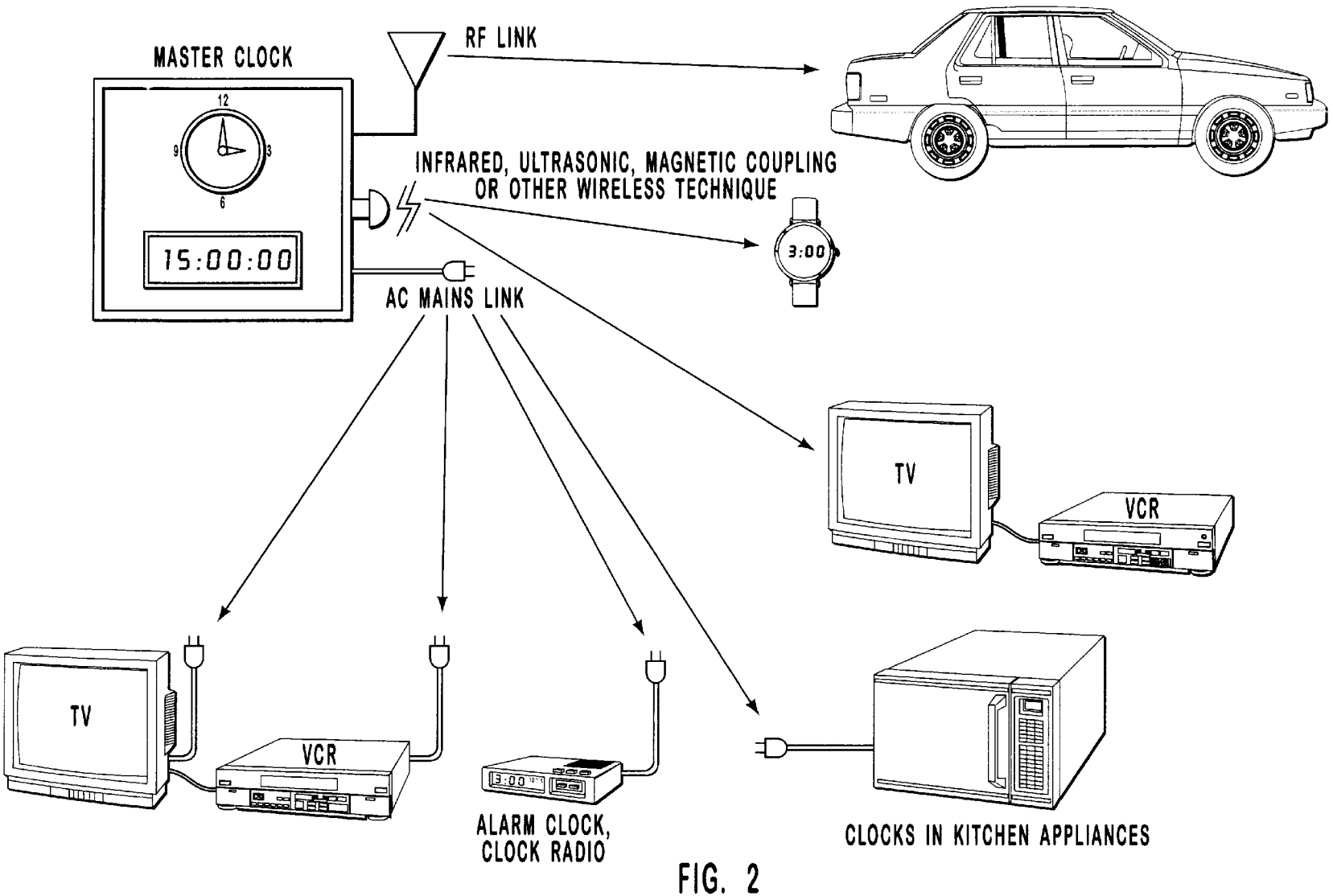
FIG. 2 describes an overall view of the components of the Automatic Clock Setting System.

This invention provides a system, device, and method for enabling the setting of clocks without the need for human intervention. The minimum system has 3 components as seen in FIG. 2:

1) a master/transmitter clock/device, or master clock, which maintains the accuracy of time for all slave/receiving clocks/devices;
2) a slave/receiving clock/device, or slave clock, or host device (appliances, etc.) containing the slave clock circuit/function, configured to receive an update from the master clock; and
3) a method of communicating information from master to slave clocks. The system may employ more than one slave clock, and more than one method of communicating information from master to slave clock(s).

A primary objective of this system is to provide a means to update slave clocks which are inexpensive, maintain time utilizing their own timebase, and are updated only as needed.

Updates to the slave clocks are event driven. Typical events which would force an update or setting of the slave clock would be:

1) the user requests one (for example, by pushing a button); or
2) the hardware/software algorithm or design of the clock forces one after:
   (a) a power outage has occurred, resulting in the clock circuits losing all time information; or
   (b) the clock has been operating for the period of time long enough to result in partial loss of time information (due to timebase inaccuracies, for example). In other words, enough time has elapsed that sufficient error has accumulated to warrant an update.

Figure 3:
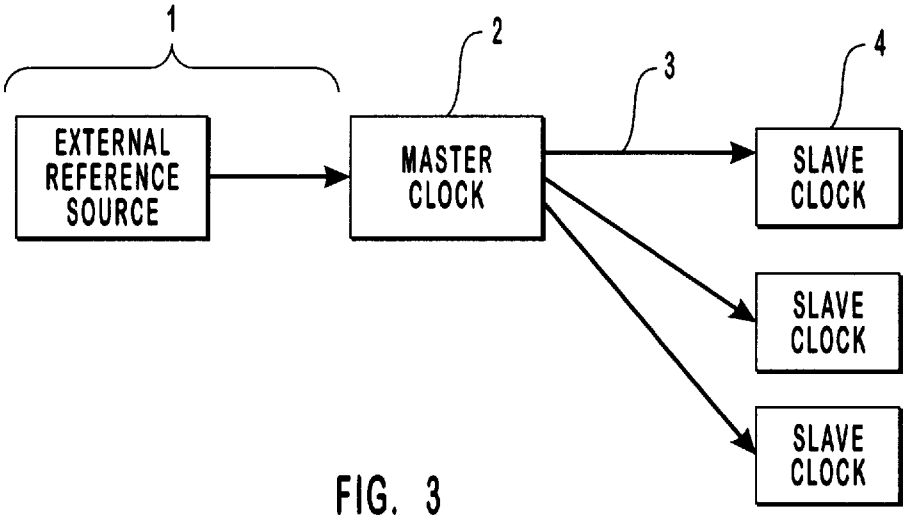
FIG. 3 is the block diagram of an Automatic Clock Setting System, consisting of (2) a master clock, (3) a transmission medium, and (4) one or more slave clocks within the range of the master clock. The master clock may optionally reference itself to an External Reference Source (1).

The system of devices making up the Automatic Clock Setting System is shown in FIG. 3. Time, date, location, and any other information which may be utilized by the slave clocks and clock circuits/functions in host devices (such as appliances, TVs, VCRs, watches, automobiles) is sent to these devices from a master clock. This master clock is equipped with the appropriate hardware to enable it to disseminate time, date, and other information within its accuracy specifications to slave clocks after a power outage and/or on a periodic basis.

Figure 4:
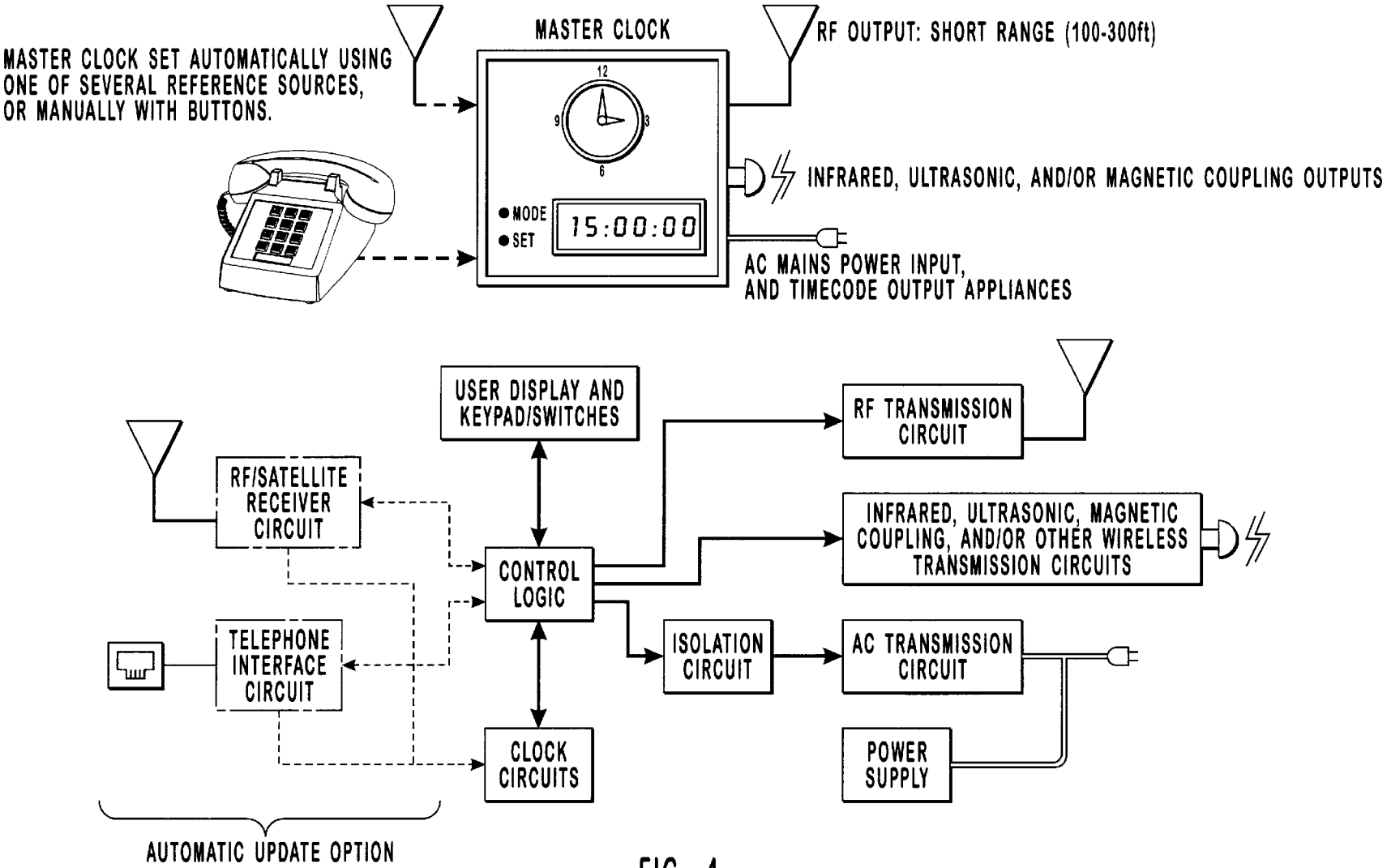
FIG. 4 describes a master clock.
Figure 5:
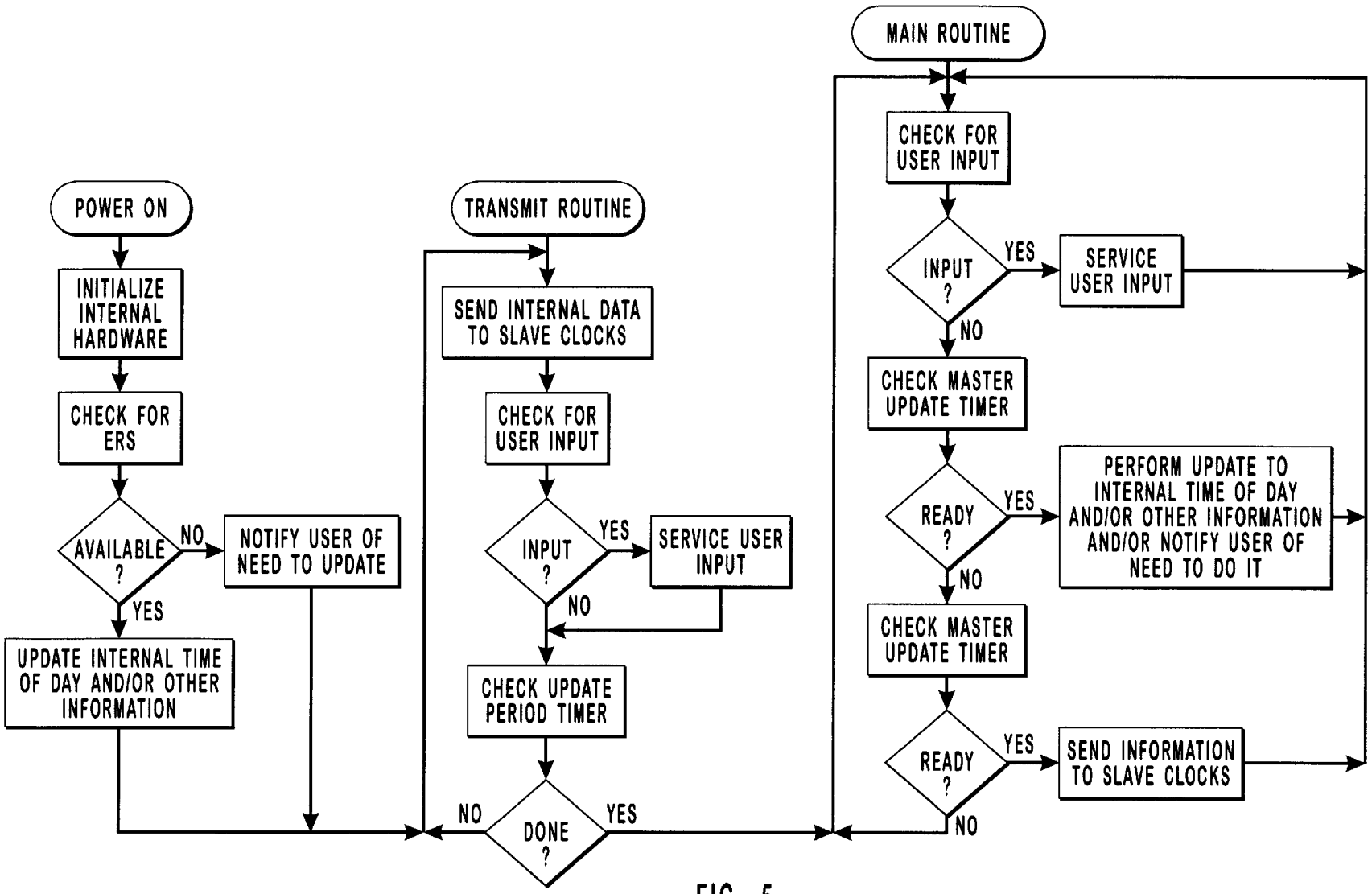
FIG. 5 is a flowchart describing a possible hardware or software algorithm used by a master clock.

The method by which the master clock (FIG. 4) receives its time of day (has its internal clock set) and/or other information would be described as:

1) manual, as input by the human user, or
2) automatic (periodic or random basis), as input from an external reference source, or ERS, such as WWV radio, the GPS or other satellites, or a telephone line service similar to the ACTS from the National Institute of Standards and Technology in Boulder, Colo., USA. These sources broadcast Universal Time Coordinated, or UTC, via wire (telephone) or wireless (radio, satellite) methods. Variations on the design of the master clock may incorporate one or the other, or both, of the manual and/or automatic methods. FIG. 5 describes an algorithm which might govern the operation of a master clock.

For the manual method of setting the master clock, the user could contact a local bank, telephone company, or other convenient source for the correct local time and input this information into the master clock. The design of the master clock may or may not employ a battery backed-up timebase/clock circuit ("flywheel") to allow it to continue to keep time in the event of a power outage.

For the automatic method, the master clock design may incorporate a receiver which picks up the time of day and/or other information from an ERS. With this method, the master clock can update itself to the correct time automatically after an event (such as a power outage), regardless of whether or not it has the option of keeping time through an event as before described.

For the automatic method, the master clock may be designed to automatically update its own internal clock registers by re-synchronizing to an ERS signal on a periodic or random basis. If the design of the master clock does not include an automatic update feature, it may include a visual indicator (such as an LED) to advise users that it needs to be set (for example, in order to maintain the accuracy of its display to within ±1 least significant digit).

For the automatic method, the master clock may be designed to continuously update its own internal clock registers by constantly transferring information from the ERS signal (or maintaining synchronization to it).

Once set, the internal timebase of the master clock is capable of maintaining time within a specified accuracy. This accuracy number, along with the time of day, an appropriate message identifier (number/character/set of characters), and an error control/correction character or characters may then be sent to all listening devices, or slave clocks.

The master clock sends information to the slave clocks, when:

1) a periodic event occurs (for example, an internal timer overflows), which triggers the sending of information once per minute, hour, or some other convenient time interval;
2) a random event occurs, such as:
   (a) the human user instructs the master clock to update all slave clocks (for example, through the push of a button); or
   (b) a power outage occurs (slave clocks are likely to have lost current information).

A provision may also be made for the human user to stop the master clock from sending information to the slave clocks.

The master clock may output information to the slave clocks either on a continuous basis, or for a limited time in order to minimize use of the transmission medium. For example, after the occurrence of an event (such as a user pushing a button) which triggers the transmission of time of day and/or other information to the slave clocks, the master clock may transmit information for 1 minute, then cease until the next triggering event occurs.

Figure 6:
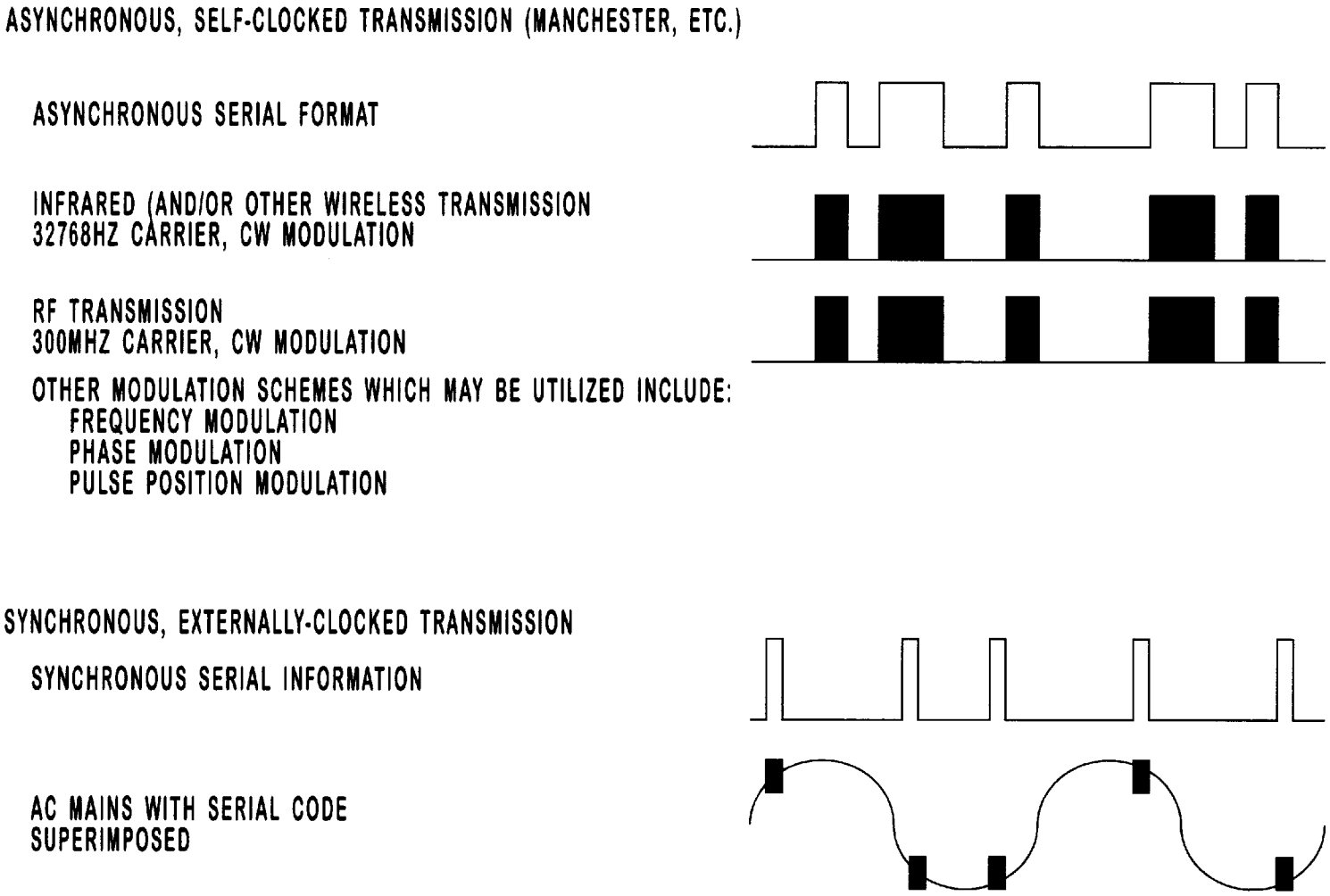
FIG. 6 describes methods of transmission/reception of information from the master clock to the slave clock(s).

The master would likely employ several hardware methods of disseminating information in order to accommodate multiple types of slave clocks. As shown in FIG. 6, hardware methods might include the superimposing of information on the AC mains, infrared light, ultrasonic, magnetic coupling, and/or RF carriers. These methods would use standard modulation schemes such as CW, AM, FM, PM, or PPM of carrier frequencies which exist, or are generated from existing frequencies, within the clock circuits.

Utilizing clock frequencies which exist in the master clock as the carrier frequencies for transmission offers the additional advantage of transmitting real-time timing information between master and slave clocks. A master clock carrier transmission frequency of, for example, 32768 Hz or a multiple thereof, may be used to transfer timing synchronization to a slave clock circuit as a by-product of being the carrier for the modulated information of, for example, time of day. Thus the raw carrier frequency as well as the information superimposed upon it may be utilized by the update process of the slave clock.

On the other hand, slave clocks with timebase frequencies unrelated to that of the master clock (for example, 50 Hz/60 Hz versus 32768 Hz) may only make use of the modulated information on the carrier.

Depending upon the hardware method, either a synchronous or an asynchronous timing technique would be employed, both for sending digital information as well as establishing a common time keeping mark in real time.

The master and slave clocks would use a message protocol which would include codes to identify message type, message information, error checking/correction, and real-time keeping information. An example code for sending/receiving the time of day might be:

(a) hexadecimal, nybble (4 bits) wide code characters, (b) message header field of 2 nybbles (1 byte)

(c) information field of a fixed or variable number of nybbles, depending upon message type. Information could include time, date, location, accuracy, or anything else as designated by a predefined message header understood by both master and slave.

(d) error detection/correction field of 1 nybble: could represent parity, checksum, or Cyclical Redundancy Check (CRC) of all characters in the information field. In order to facilitate the using of readily available asynchronous communications hardware, the total message length could be kept to multiples of 8 bits (2 nybbles, or 1 byte).

A 10-nybble fixed-size message to send/receive the time of day might look like the following: FF65164322, where (a) FF (hexadecimal) is the message header code telling the slave clocks that time of day is coming next;

(b) 6 is the accuracy code, representing the PPM accuracy of the clock;

(c) 516432 is the Least Significant Digit (LSD) to the Most Significant Digit (MSD) code for 23:46:15 hours time; and (d) 2 represents the checksum.

For example, a message sent synchronously over the AC mains communicating to the slave clocks the current time of day might use a fixed length of 10 nybbles total, such as shown above. Since it is sent synchronously, the slave clocks using the AC mains as part of their timebase could make use of the start of the next cycle (low-to-high transition) of the AC mains signal past the checksum as the timing mark to begin their time keeping operation.

A time of day message sent asynchronously to a slave clock in a watch, for example, would use a real-time timing mark sent after the message, allowing the slave clock to trigger on the precise point in time from which to begin its time keeping operation.

The slave clocks receive information updates (such as time of day, date, and/or location) from the master clock whenever directed to by an event such as:

1) the human user desires one (for example, by pushing a button); or 2) an internal hardware circuit and/or software algorithm determines the clock circuit should be updated.

Figure 7:
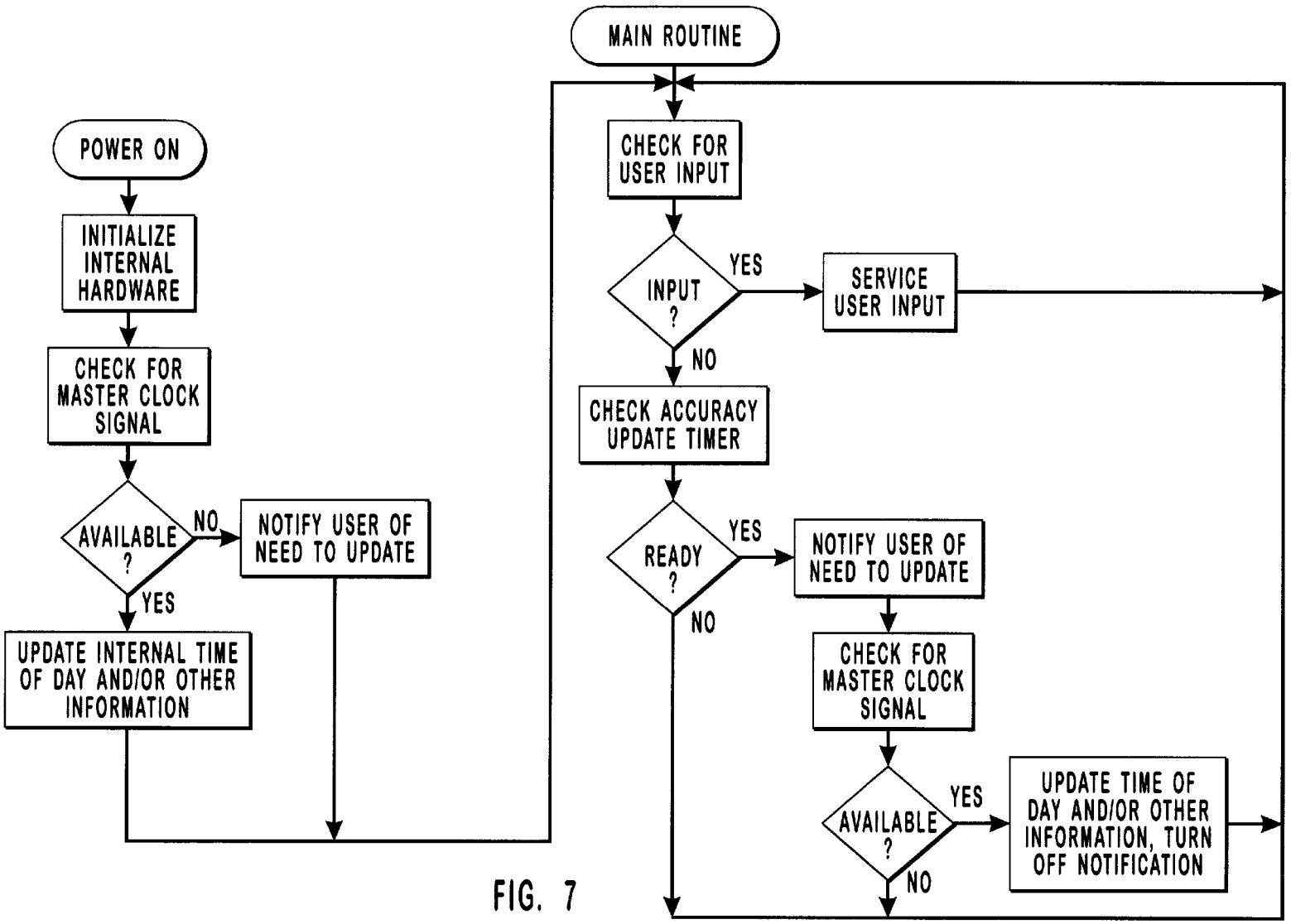
FIG. 7 is a flowchart of the hardware or software algorithm for a slave clock.

There are two classes of events which would enable the slave clock to do this:

(a) a power outage occurred (the clock circuit loses all or part of its stored information); or (b) a certain length of time has passed (the clock loses partial information), resulting in degraded performance which may be noticeable by the user. FIG. 7 describes an algorithm which might govern the operation of a slave clock.

With reference to 2*b*) above, the pre-determined time that a slave clock waits before enabling the reception of an update would be set at the time of design and/or manufacture. It could be related to the accuracy and stability performance of the slave clocks'internal timebase design (relative to a universal standard such as UTC). Thus, the time could be fixed so that the user would be guaranteed that the clock display would be accurate to a value easily measured by the user. An example might be to within ±1 least significant display digit or, in the case of most digital watches, one second. The slave clock keeps no record of the changes to its time keeping ability over time. Thus, the decision to get updated information from the master clock based on the real time passed since the last update does not require an on-going, constantly updated history of its time keeping ability. Instead, use a simple, designed-in trigger mechanism to perform the update process will suffice. This necessarily simplifies and minimizes the cost of implementing a slave clock design.

A slave clock design also might allow for an update from the master clock only after a common event in the system, such as a power outage.

Slave clocks are envisioned as being time keeping devices which employ automatic setting capabilities compatible with the methods used by the master clock. A microprocessor may be used as all or part of the hardware to implement the receiver clock. However, it is not necessary to utilize a microprocessor in a clock incorporating the aspects of this invention since no history of the clock's performance relative to a standard need be kept.

Figure 8:
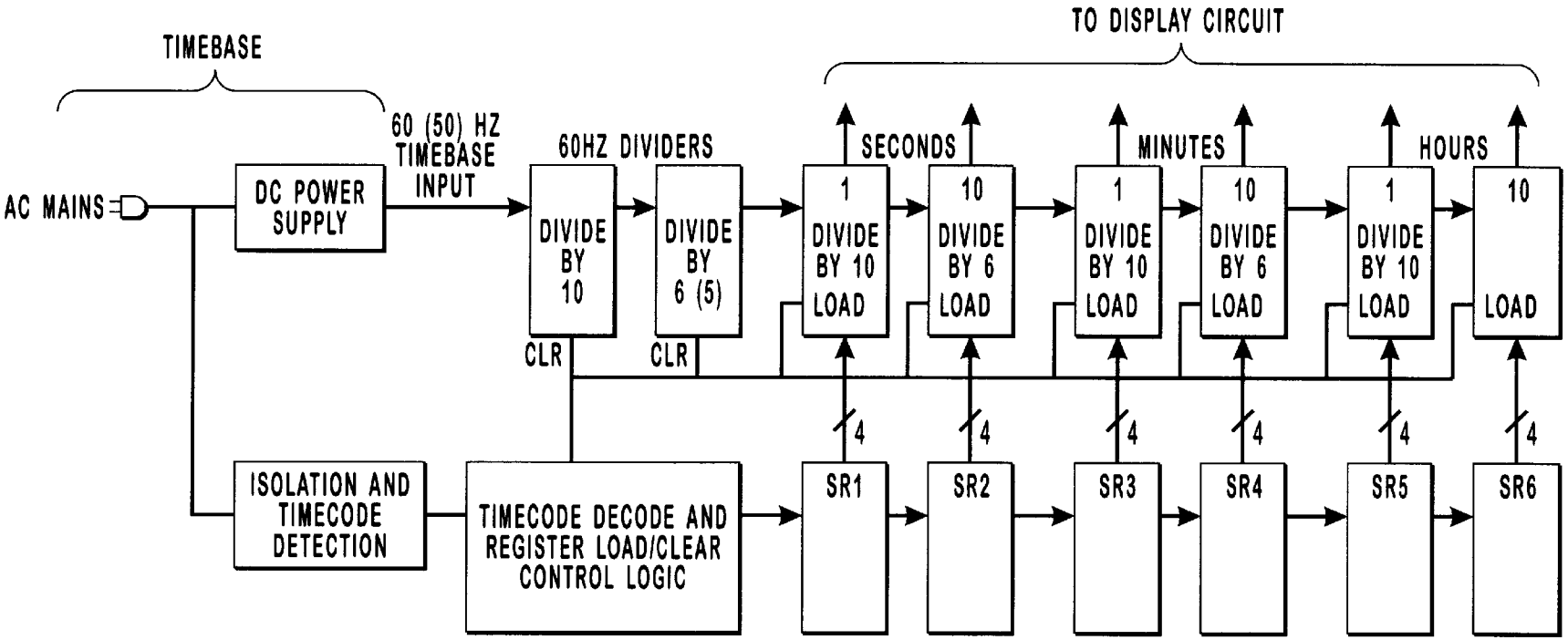
FIG. 8 describes in block diagram form a slave clock which utilizes the 50 Hz/60 Hz signal from the AC mains as the reference oscillator.

The circuit in FIG. 8 is a slave clock which does not utilize a microprocessor. The circuit's time registers are unique in that they allow parallel load of time of day information from a set of time code, or serial, shift registers (SR1 through SR6), and clearing of the 50 Hz/60 Hz dividers for correct timebase synchronization to a reference signal. Circuits to isolate the clock circuit from the AC mains power, detect and output the time code, and control loading of the time code shift registers and eventual updating of the time registers also form part of the device. Information sent from the master clock would likely be sent synchronously to this slave clock over the AC mains to simplify design and parts requirements.

Figure 9A:
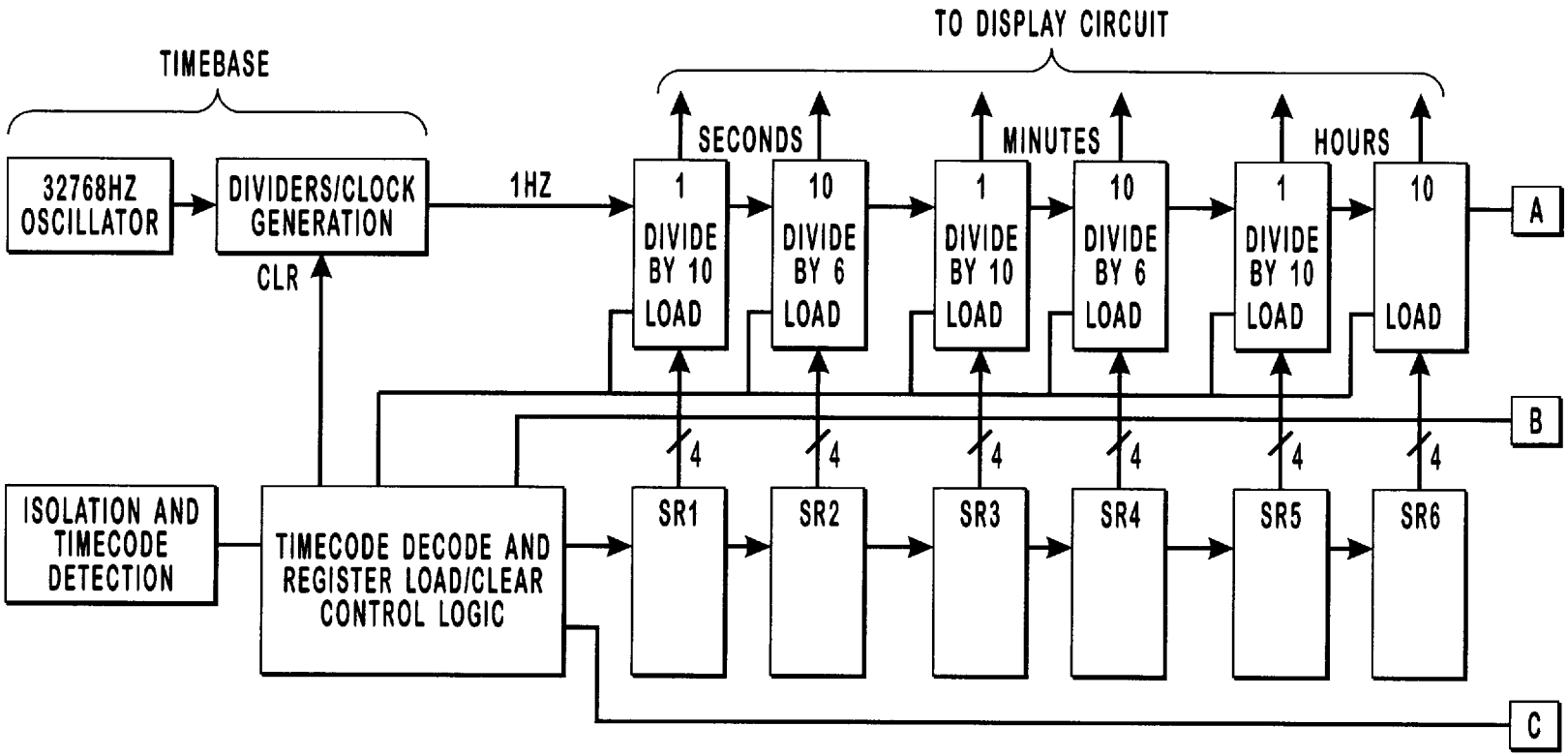
FIG. 9 describes in block diagram form a slave clock which utilizes a timebase with an independent reference oscillator.
Figure 9B:
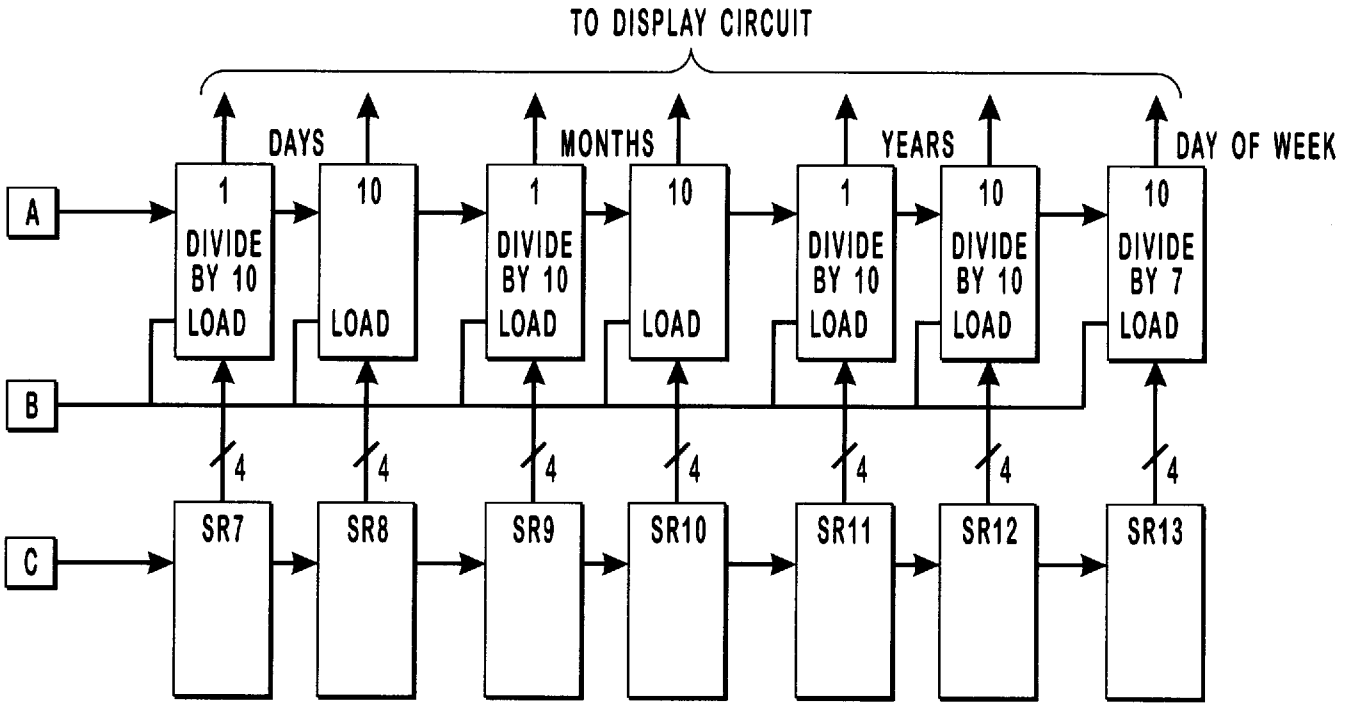

The circuit in FIG. 9 describes a slave clock which utilizes a timebase with an independent reference resonator or oscillator, in this case at a frequency of 32768 Hz. The host device may utilize time of day, date, day of the week, or even location (latitude/longitude) information sent from the master clock. Assuming the clock circuit is battery powered, such as in a wrist watch, information sent from the master clock would be received asynchronously via a wireless transmission medium. This diagram differs from FIG. 8 also in that more registers are needed to hold the information beyond time of day.

When an update event occurs, the slave clock "looks" for time of day and/or other information from the master clock. It may use one of the hardware methods shown in FIG. 6, and an associated software protocol as previously described for the master clock. It recognizes the message identifying numbers/character(s), checks the embedded accuracy character against its own, receives the information, and checks for errors in transmission using the embedded error control/correction code. If it finds an error in transmission, or that the time information accuracy is worse than what it already has, control circuits may simply reject the information and wait for another transmission. If there are no errors, the information is assumed good and may be loaded into the internal clock registers. At the proper time, the slave clock resumes time keeping using its own internal timebase.

Both asynchronous and synchronous methods might be employed to receive information from a master clock.

A simple serial update/compare algorithm may be used to govern the update process of a slave clock. The clock circuits could be designed to always update internal registers after correctly receiving a message from a "superior" clock, or to do a compare and update only if different.

It is important to note that communication of time information occurs one-way, from master clock of superior accuracy, to the slave clock of inferior/questionable accuracy. No feedback loop between master and slave clocks for the purpose of improving the timebase accuracy of the master and/or slave clocks is utilized by this invention.

Once set, a slave clock may actually have a better stability than the master clock from which it was set. An example might be a slave clock/clock circuit which utilizes the 50 Hz/60 Hz AC mains signal as a timebase. Due to the ambiguity which exists between the zero crossing point of AC mains waveform and the occurrence of, say UTC 1PPS as measured through GPS, the slave clock will always have a permanent offset, or inaccuracy, with respect to UTC. However, owing to the stability of the 50 Hz/60 Hz mains frequency generated by the local power company, the slave clock may actually be more stable than a master clock that, though crystal controlled for example, is allowed to drift over time. If desired, a slave clock of this design may utilize internal analog or digital delay circuits to negate this time offset, thus improving its accuracy while capitalizing on the stability inherent in an AC timebase.

Figure 10:
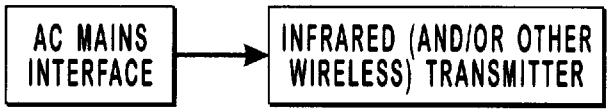
FIG. 10 describes a REPEATER, which is a combination receiver and transmitter circuits that repeat information received from the master clock to slave clocks normally outside of its influence.
Figure 11:
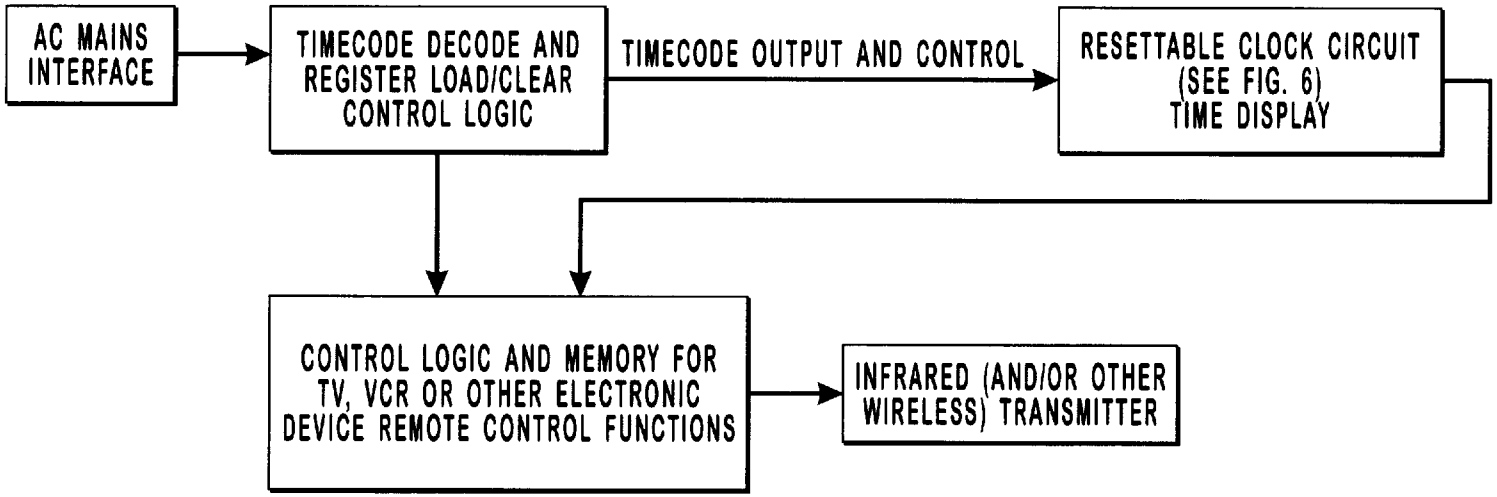
FIG. 11 describes a combination master and slave clock called a TRANSLATOR.

Repeater devices (FIG. 10) are a combination of the receiver and transmitter functions/devices. The repeater receives time of day and/or other information from a master clock and transmits it to slave clocks which are outside the influence of dissemination method employed by the master clock (for example, due to physical distance or house wiring convention). These devices may or may not employ internal clock circuits/displays. They repeat (receive and re-transmit) the information either from one medium to another (for example, from RF to the AC mains, or AC mains to infrared, etc.), or within the same medium (for example, an infrared range extender). Translator clocks/devices (FIG. 11) are a combination of slave and master clocks. They receive time of day and/or information from a master clock and re-transmit the information to slave clocks or devices which use methods and/or codes not compatible with those employed by the master clock. These devices may or may not employ internal clock circuits/displays. An example would be a clock/device which receives time from the mater clock and then sets the clock in a host electronic appliance such as a VCR or television utilizing the host infrared interface and codes.

Figure 12:
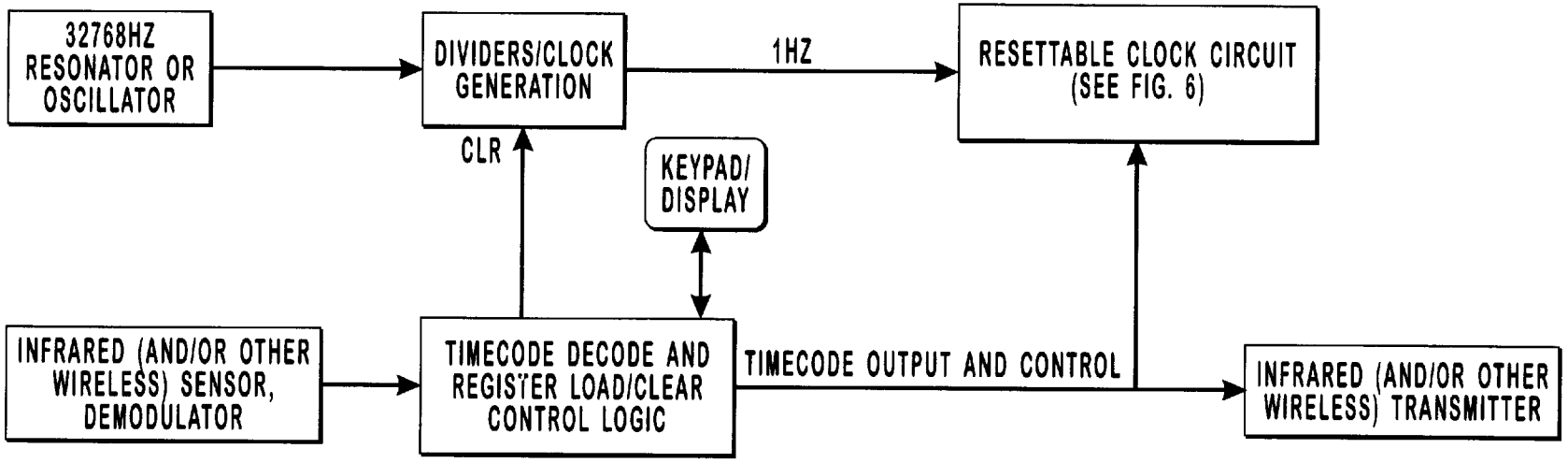
FIG. 12 describes a combination REPEATER and TRANSLATOR, since it performs the functions encompassed by both of these devices.

Clocks/devices may also exits which are a combination of translator and repeater devices (FIG. 12). An example might be a hand-held remote control device which incorporates the methods used by this system for setting time of day and/or other information in slave clocks outside the influence of the master clock such as in an automobile (i.e., a repeater), as well as existing methods/codes for setting clocks in host devices which employ infrared interfaces such as a VCR (i.e., a translator).

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for updating the time of a remote host device, the system comprising:

(a) a remote host time piece device for maintaining the time of day and having a timebase with a reference from an electronic input;

(b) a master time piece for obtaining the correct time and for transmitting the correct time to the remote host time piece device;

(c) means for accepting the transmission of the correct time from the master time piece and for setting the time of day in the remote host time piece device to the correct time transmitted from the master time piece;

(d) means, remote from the master time piece, for initiating from the master time piece the transmission of the correct time to the remote host time piece device upon the occurrence of at an event; and wherein:

the master time piece transmits to the remote host time piece device an accuracy number that is used to determine based upon a selected tolerance whether the transmitted correct time from the master time piece is to be accepted for setting the time of day in the remote host time piece device to the correct time transmitted from the master time piece.

2. The system as defined in claim 1, wherein the timebase with the reference from the electronic input is from at least one of:

(i) an AC mains line frequency;

(ii) a resonator or oscillator having a selected number of cycles per second;

(iii) an oscillator of a control logic device for an electrical appliance; and (iv) a reference oscillator for a radio frequency device including at least one of a transmitter and a receiver.

3. The system as defined in claim 1, wherein the occurrence of the event is from at least one of:

(i) a user input;

(ii) a restoration of power to the remote host time piece device following a loss of power to the remote host time piece device; and (iii) an elapse of a selected time period after the setting of the time of day in the remote host time piece device to the correct time transmitted from the master time piece.

4. A system for updating the time of a remote host time piece device, the system comprising:

a. a remote host time piece device for maintaining the time of day and having a timebase with a reference from at least one of:

(i) an AC mains line frequency;

(ii) a resonator or oscillator having a selected number of cycles per second;

(iii) an oscillator of a control logic device for an electrical appliance; and (iv) a reference oscillator for a radio frequency device including at least one of a transmitter and a receiver;

b. a master time piece for obtaining the correct time and for transmitting the correct time to the remote host time piece device;

c. means for accepting the transmission of the correct time from the master time piece and for setting the time of day in the remote host time piece device to the correct time transmitted from the master time piece;

d. means, remote from the master time piece, for initiating from the master time piece the transmission of the correct time to the remote host time piece device upon the occurrence of at least one of:

(i) a user input;

(ii) a restoration of power to the remote host time piece device following a loss of power to the remote host time piece device; and (iii) an elapse of a selected time period after the setting of the time of day in the remote host time piece device to the correct time transmitted from the master time piece, and wherein:

the master time piece transmits to the remote host time piece device an accuracy number that is used to determine based upon a selected tolerance whether the transmitted correct time from the master time piece is to be accepted for setting the time of day in the remote host time piece device to the correct time transmitted from the master time piece.

5. The system as defined in claim 4, wherein the master time piece obtains the correct time from at least one of:

(i) a time manually input by a user; and (ii) a external reference source time received by signals in the form of electromagnetic radiation.

6. The system as defined in claim 4, wherein the master time piece obtains the correct time from automatically after a restoration of a power outage thereto.

7. The system as defined in claim 4, wherein the master time piece obtains the correct time from automatically by re-synchronizing to an external reference source.

8. The system as defined in claim 4, wherein the remote host time piece device displays the time of day it maintains.

9. The system as defined in claim 4, wherein the remote host time piece device further comprises:

at least first and second remote host time piece devices, the first remote host time piece device receiving the correct time from the master time piece and then re-transmitting the correct time to the second remote host time piece device.

10. A system for updating the time of a remote host time piece device, the system comprising:

a. a remote host time piece device for maintaining the time of day and having a timebase with a reference from an AC mains line frequency;

b. a master time piece for obtaining the correct time and for transmitting the correct time to the remote host time piece device;

c. means for accepting the transmission of the correct time from the master time piece and for setting the time of day in the remote host time piece device to the correct time transmitted from the master time piece;

d. means, remote from the master time piece, for initiating from the master time piece the transmission of the correct time to the remote host time piece device upon the occurrence of a user input; and wherein:

the master time piece transmits to the remote host time piece device an accuracy number that is used to determine based upon a selected tolerance whether the transmitted correct time from the master time piece is to be accepted for setting the time of day in the remote host time piece device to the correct time transmitted from the master time piece.

11. The system as defined in claim 10, wherein the master time piece obtains the correct time from at least one of:

(i) a time manually input by a user; and (ii) a external reference source time received by signals in the form of electromagnetic radiation.

12. The system as defined in claim 10, wherein the master time piece obtains the correct time from automatically after a restoration of a power outage thereto.

13. The system as defined in claim 10, wherein the master time piece obtains the correct time from automatically by re-synchronizing to an external reference source.

14. The system as defined in claim 10, wherein the remote host time piece device further comprises:

at least first and second remote host time piece devices, the first remote host time piece device receiving the correct time from the master time piece and then re-transmitting the correct time to the second remote host time piece device.

* * * * *